US007144129B2

(12) United States Patent
Mackin

(10) Patent No.: US 7,144,129 B2
(45) Date of Patent: Dec. 5, 2006

(54) LIGHT FIXTURE WITH EXTRUDED METAL HOUSING

(75) Inventor: Michael P. Mackin, Chicago, IL (US)

(73) Assignee: Woodhead Industries, Inc., Deerfield, IL (US)

( * ) Notice: Subject to any disclaimer, the term of this patent is extended or adjusted under 35 U.S.C. 154(b) by 217 days.

(21) Appl. No.: 10/923,143

(22) Filed: Aug. 18, 2004

(65) Prior Publication Data

US 2005/0041417 A1 Feb. 24, 2005

Related U.S. Application Data

(60) Provisional application No. 60/496,025, filed on Aug. 19, 2003.

(51) Int. Cl.
*F21S 8/00* (2006.01)
*F21S 7/20* (2006.01)

(52) U.S. Cl. ..... 362/223; 362/218; 362/219; 362/362

(58) Field of Classification Search ..... 362/218, 362/219, 223, 362; 220/4.02
See application file for complete search history.

(56) References Cited

U.S. PATENT DOCUMENTS 3,265,885 A * 8/1966 Porter ..... 362/218
4,338,653 A * 7/1982 Marrero ..... 362/223
4,845,601 A * 7/1989 Podbury et al. ..... 362/125
4,858,087 A * 8/1989 Hartshorn ..... 362/219
4,985,815 A * 1/1991 Endo ..... 362/294
5,001,613 A * 3/1991 Foster et al. ..... 362/223
5,154,507 A * 10/1992 Collins ..... 362/218
5,479,327 A * 12/1995 Chen ..... 362/222
5,690,419 A * 11/1997 Siems ..... 362/269
5,984,490 A * 11/1999 Leen ..... 362/240
6,132,061 A * 10/2000 Andrus et al. ..... 362/217
6,152,573 A * 11/2000 Mitchell ..... 362/217
6,472,823 B1 * 10/2002 Yen ..... 315/112

* cited by examiner

*Primary Examiner*—Sandra O'Shea
*Assistant Examiner*—Ismael Negron
(74) *Attorney, Agent, or Firm*—Emrich & Dithmar LLC

(57) ABSTRACT

A light fixture includes an extruded metal housing having open ends, and a wall defining an elongated opening extending between opposing wall edges. First and second slots extend along opposing edges of the wall to receive at least one panel. A pair of end plates is attached to the open ends of the housing. A lamp assembly is mounted within the housing for transmitting light through the elongated opening. More than one lamp assembly may be slid into the extruded housing, with spacer plates inserted between lamp assemblies to present a closed, finished look. The extruded housing may by cut to size and end caps inserted with screws to finish the fixture.

5 Claims, 4 Drawing Sheets

LIGHT FIXTURE WITH EXTRUDED METAL HOUSING

RELATED U.S. APPLICATION DATA

This application claims the benefit of co-pending, co-owned U.S. Provisional Application No. 60/496,025 filed on Aug. 19, 2003 for "SHOP LIGHT WITH EXTRUDED METAL HOUSING".

FIELD OF THE INVENTION

The present invention relates to lighting fixtures in general; and more particularly, it relates an overhead lighting fixture of the type used in workshops, garages, basements or the like, and commonly referred to as a "shop light". The invention is suitable for use in residential, commercial or industrial environments, for example, in a shipping room or a storage area.

BACKGROUND AND SUMMARY OF THE INVENTION

Shop lights have enjoyed widespread use both in residential applications, such as basements, workshops, garages and plant growing areas, and they have also enjoyed widespread use in commercial and industrial applications, such as shipping rooms, mail rooms, service stations and the like.

Many shop lights are utilitarian in look, fabricated from painted sheet metal and including other components which provide a general unfinished look. Further, shop lights in current use have housings which are typically fabricated to size. That is, the housing for a twenty-four inch flourescent lamp would have to be fabricated from a different set of tools than that to house a thirty or thirty-six inch flourescent lamp.

Further, current shop light fixtures are not generally suitable for applications for different light sources such as flourescent or halogen lamps, largely because of the greater heat generated by halogen lamps.

One object of the present invention is to provide an extruded metal housing for shop lights adapted to different applications as well as different light sources. For example, the same housing can be used for flourescent lamps of different length simply by cutting the housing extrusion to the desired length. Moreover, the same housing, which is formed from extruded metal, can be used for different lamps, including flourescent, ultra violet or "black" light, or halogen light sources because the ability of the extruded housing to dissipate heat is great enough to accommodate all of these light sources. Moreover, the shape of the extruded housing adds further strength to resist deformation or bending.

Other features and advantages of the invention will be apparent from the following description of two separate embodiments, accompanied by the attached drawing wherein identical reference numerals will be used to refer to like parts in the various views.

DETAILED DESCRIPTION OF THE ILLUSTRATED EMBODIMENTS

Figure 1:
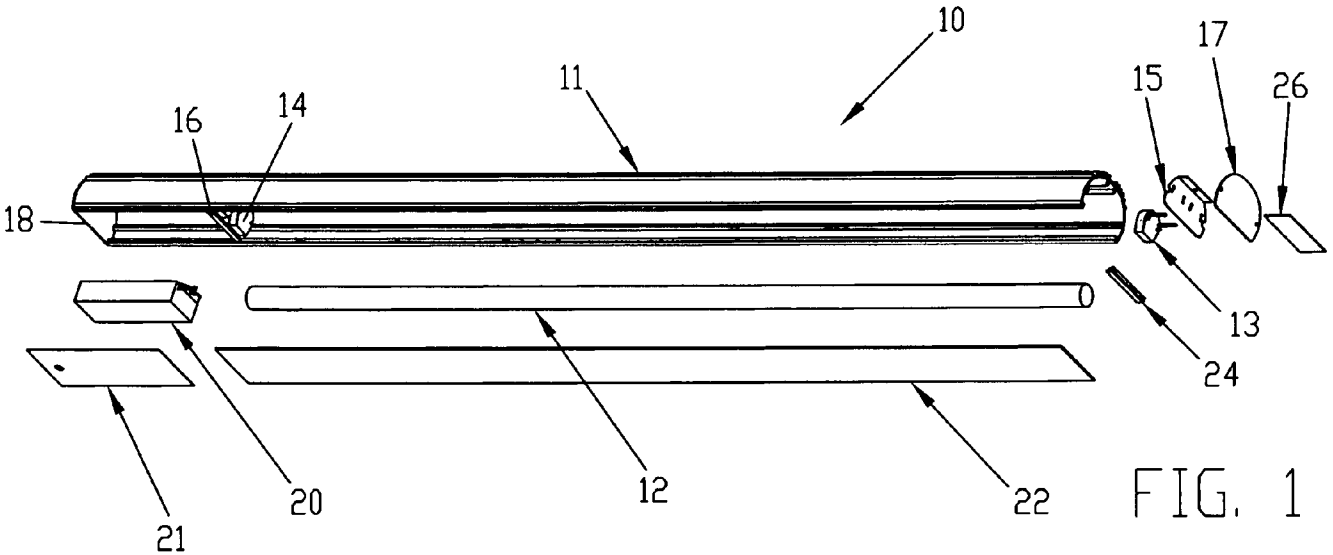
FIG. 1 is a lower perspective view of a flourescent shop light fixture constructed according to the present invention with the main components in exploded relation.

Turning first to FIG. 1, reference numeral 10 generally designates a shop light fixture adapted to a fluorescent lamp, with some of the components shown in exploded relation. The light fixture 10 includes an elongated housing 11 which is in the form of a wall or partial enclosure comprising a metal extrusion (e.g. aluminum or aluminum alloy), seen in cross section in FIG. 2. Hence, the housing 11 may be cut to any desired length. Within the housing 11 is a conventional fluorescent lamp 12 mounted by respectively fluorescent lamp sockets 13, 14. The sockets 13, 14 in turn are mounted to the housing 11 by brackets 15, 16. The open ends of the housing 11 are provided with end covers designated respectively 17 and 18 in FIG. 1.

A conventional ballast 20 is mounted in the left side of the housing 11, and it is enclosed within the housing and a cover 21. Beneath the flourescent lamp 12 is a lamp guard or lens 22 which is made of a suitable clear or translucent plastic. A section of a channel, designated 24 in FIG. 1 is received and mounted in the housing 11 for supporting the right side of the lamp guard 22; and a smaller cover plate 26 is mounted to the housing 11 to cover the space between the right side of the lamp guard 22 and the right end cover 17.

Figure 2:
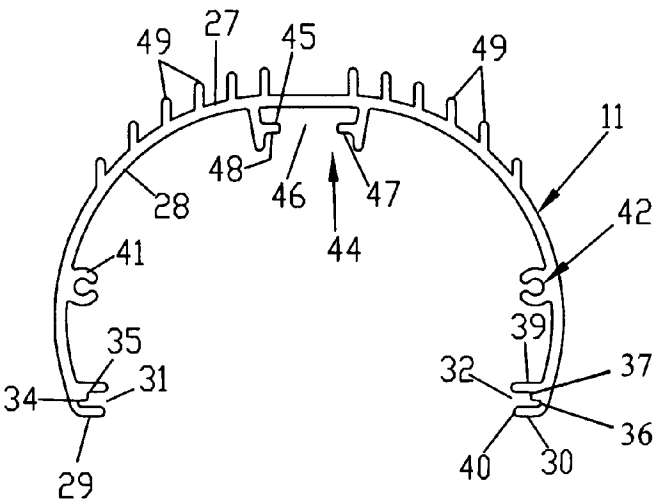
FIG. 2 is a vertical end view of the housing of the shop light of FIG. 1.

Turning now to FIG. 2, the extruded housing 11 is seen from the right side. Since the housing 11 is extruded, a cross section shown at any location along the length would have the same shape as shown in FIG. 2. The housing 11 comprises a continuous wall 28 extending from a first edge 29 to an opposing edge 30. The wall 28, when turned on its side (that is, rotated counterclockwise a quarter turn from that shown in FIG. 2) forms a generally rounded or "C" shape, with a continuous, elongated opening 27 of the "C" shape extending between the two opposing edges 29, 30. This provides a housing for receiving the lamps and other components of the fixture. For the illustrated embodiment, the width of the housing (FIG. 2) is greater than the height of the housing. This is more aesthetic than functional, but it does add strength and resistance to bending, but other proportions of height and width may be used.

Adjacent the edges 29, 30, elongated mounting slots designated respectively 31 and 32 are formed in opposing relation. The slots 31, 32 are formed in mirror image. Turning to the slot 31, it includes a first, deeper lateral recess 34, and a second, more shallow recess 35 located above the recess 34, but in communication with the recess 34. Similarly, the slot 32 has a deeper recess 36 aligned with the recess 34 of slot 31, and a more shallow, upper recess 37 in horizontal alignment with the recess 35 of the slot 31. This is referred to as a dual mounting slot because components of two different widths may be mounted in the pairs of opposing recesses 34, 36 and 35, 37 respectively, and extended along the longitudinal direction of the housing opening 27 to any desired length.

It will also be observed that each of the slots 31, 32 is defined by an upper shelf and a lower support shelf, such as those designated 39, 40 for the slot 32 in FIG. 2. Each pair of opposing shelves forms a support platform for components, if desired. The wider, lower slots 34, 36 receive the longitudinal edges of the plastic guard or lens 22 for supporting it; and the supports formed by the combined height of the recesses 34, 35 (for example, for the slot 31) receive and support the cover panel 21.

Above the slots 31, 32 and located approximately at the greatest width of the housing 11 are opposing open channels 41, 42 located on the inner surface of the housing and forming screw bosses for receiving screws mounting the end plates 17, 18.

At the top of the housing 11, on the inside surface, is an upper mounting slot generally designated 44 forming a rectangular channel 45 with a downwardly facing central opening 46 extending the length of the housing extrusion and providing a means for slidably locating a hanger, such as a threaded nut for supporting components within the housing 11. The slot 44 is partially defined by inwardly extending opposing shelves or ledges 47, 48 which serve as a support platform for hanging components such as a reflector or a holder for the ceramic lamp to be described below. The channel 45 may also serve as a raceway for routing electrical wires.

Formed integrally with the extruded housing 28 are a series of fins designated 49 and located in equal numbers on either side of the vertical centerline of the housing. In the illustrated embodiment, there are six fins to either side of the vertical centerline, and the two uppermost fins are spaced wider apart for providing space for the cords which suspend the fixture.

The fins 49 provide a decorative appearance, but they also function as heat conducting elements extending the length of the housing for transferring heat to the atmosphere from the interior of the housing.

Figure 3:
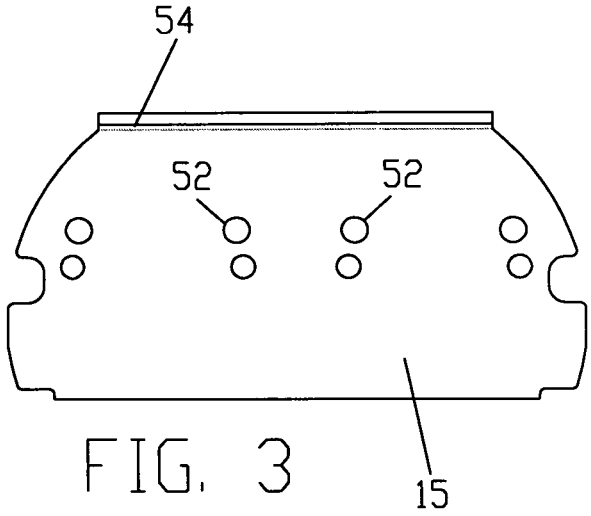
FIG. 3 is a side view of a bracket used to mount the lamp sockets of the fixture of FIG. 1.

Turning now to FIG. 3, there is shown the bracket 15 in more detail. The bracket 15 may be made of plastic or other non-conducting material so that it may mount a socket such as the ones designated 13, 14 in FIG. 1, for the lamp 12. Mounting holes are designated 52 in FIG. 3. The upper edge of the bracket 15 is struck at a right angle to form a ledge 54 which is spaced beneath the upper interior channel 45.

Figure 5:
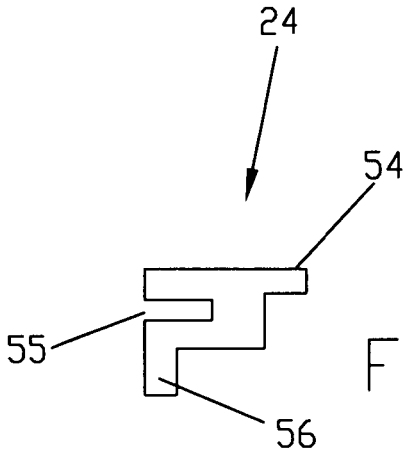
FIG. 5 is an end view of the channel member shown in FIG. 1.

Turning now to FIG. 5, the channel member 24 is seen in an end view as having an upper flange 54, a slot 55 and a downwardly extending foot 56. The adjacent narrow edge of the lamp guard 22 is received in the slot 55; and the channel 24 is cut to a length such that it fits between but is not supported by the opposing edges 29, 30 of the housing.

Figure 4:
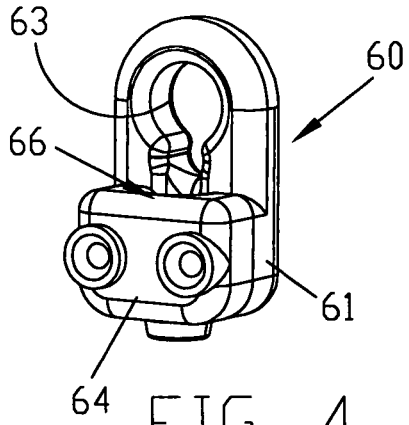
FIG. 4 is a perspective view of a cord clamp used in connection with the present invention.
Figure 6:
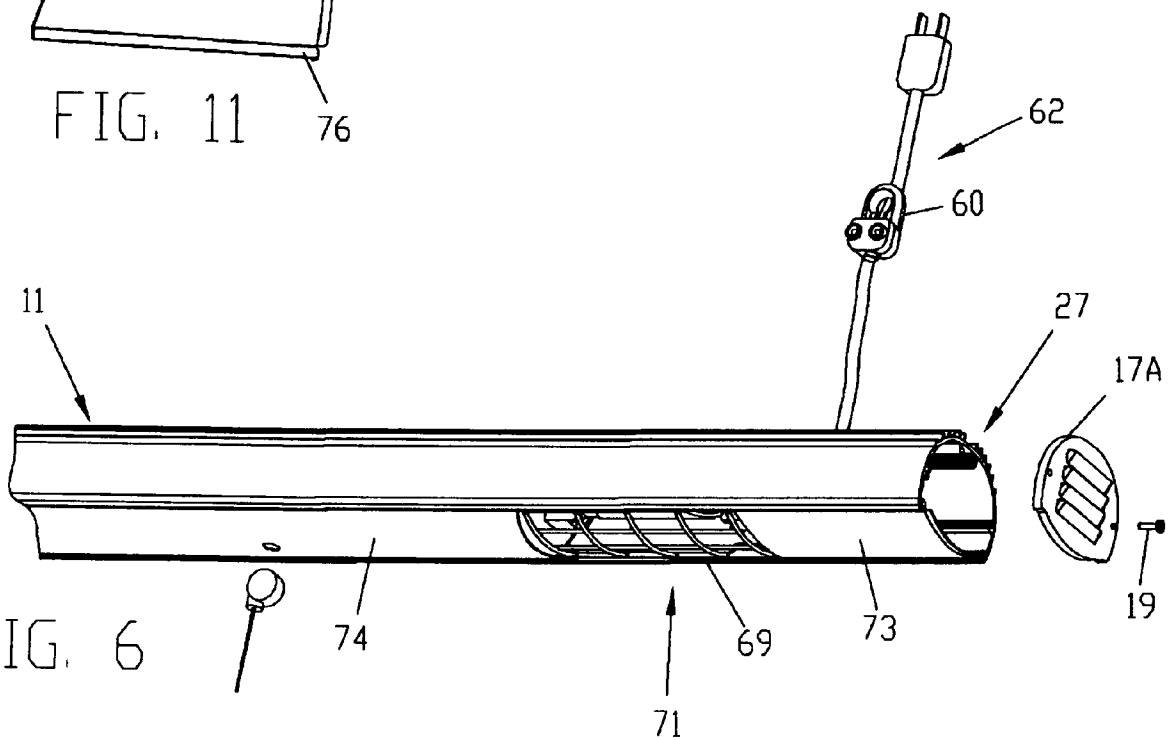
FIG. 6 is a lower perspective view of a second embodiment of the inventive light fixture having a halogen lamp, with some portions shown in exploded relation, and partially cut away for brevity.

Turning now to FIG. 4, there is shown a cord clamp 60 having an upright base portion 61 defining an aperture 63; and a removable clamp member 64 which may be secured to the base 61 by threaded fasteners (received in the screw receptacles 65 to secure clamp 64 to the base 61). When the clamp member 64 is secured to the base 61, there is provided a vertical opening 66 for receiving and clamping to a cord. The aperture 63 may serve either as a hanging aperture (an S-hook and chain may be suspended from the ceiling with the S-hook received in the aperture 63). Alternatively, the cord for the fixture may extend through the upright aperture 66 in a generally vertical direction and then be turned at a right angle and fed though the horizontal aperture 63 for further securing the cord. In this case, the cord itself may serve to mount the fixture. The use of the cord clamp 60 as a strain relief member is seen in FIG. 6 for the cord set 62. However, if the mounting cord is an electrical cord and has a connector on the end, the clamp 60 would be separately supported by a chain and thus provide strain relief for the connector. The other side of the fixture may be supported by an electrical cord with a similar cord clamp and cord suitably secured to the housing.

Turning now to the second embodiment of the invention, illustrated in FIGS. 6–10, the previously described extruded housing 11 is again used, in the form already described as the housing 11. An end cover such as the one designated 17A in FIG. 6, may be secured to the end of the housing 11 by threaded fasteners, such as the one designated 19 in FIG. 6, received in the adjacent, open ends of the extruded channels 41, 42 (FIG. 2), which act as bosses to receive screws 19.

Supported at an intermediate position in the housing 11 is a halogen lamp assembly, including a protective open grid 69, above which is mounted a lamp and reflector assembly generally designated 71. The space to either side of the lamp and reflector assembly 71 is covered with suitably formed cover plates, such as the shorter one designated 73 and a longer one designated 74. In this manner, a number of the lamp and reflector assemblies 71 may be mounted at spaced intervals along the length of the housing 11. The cover panels 73, 74 are assembled by inserting them in the previously described deeper recesses 34, 36 of slots 31, 32 formed respectively in the edges 29, 30 of the extruded housing 11.

Figure 11:
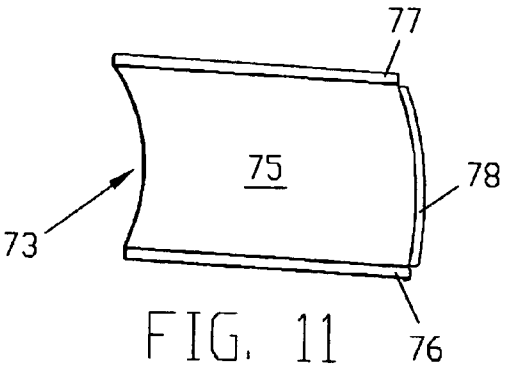
FIG. 11 is a perspective view of a cover used in the embodiment of FIG. 6.

The general shape of a cover panel, regardless of its length, is seen in FIG. 11 and described in relation to the shorter cover panel 73. The cover panel 73 has a bowed or curved center portion 75 and two outwardly extending mounting side flanges 76, 77 and an offset outer end flange 78, in the case of an end panel for overlapping the base of the end cover 17 to avoid light leaks or cracks.

Figure 10:
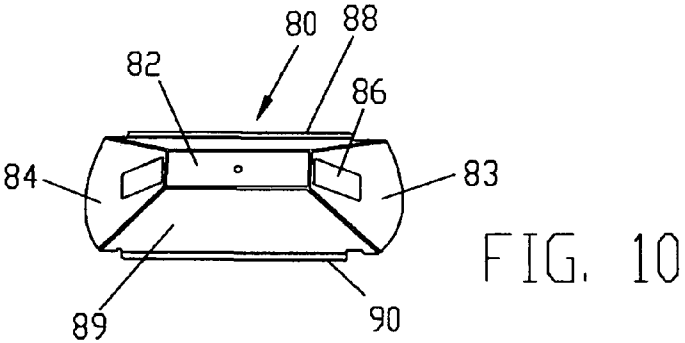
FIG. 10 is an upper perspective view of a reflector used in the embodiment of FIG. 6.

Turning now to FIG. 10, there is shown a reflector which forms part of a lamp and reflector assembly, the reflector being designated generally by reference numeral 80 and having four downwardly and outwardly extending sides, and a flat top. The top is designated 82 in FIG. 10, the downwardly and outwardly extending sides designated 83, 84 respectively in FIG. 10 extend transverse to the direction of elongation of the housing 11. The reflector 80 also includes opposing side walls 88, 89 which extend outwardly and downwardly from the top 82 and along the direction of elongation of the housing 11. Top wall 82 has an aperture 85 for mounting a conventional ceramic holder for a halogen lamp. The sides 83, 84 are apertured (as at 86 for the side 83) to permit the passage of heated air from within the wall to promote heat conduction away from the underside of the reflector.

Each of the end walls 88, 89 have their lower edge provided with an outwardly extending mounting flange such as the one designated 90 in FIG. 10. The mounting flanges of the end walls are received in the slots 31, 32 formed at the lower edges 29, 30 of the extrusion.

Figure 9:
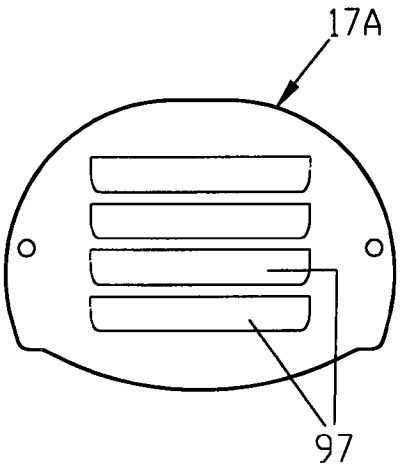
FIG. 9 is a side view of an end cap used in the halogen fixture of FIG. 6.

The end cap 17A, seen in FIG. 9, may have heat louvers such as those designated 92 in FIG. 9. This permits the heated air within the fixture to be vented.

Figure 8:
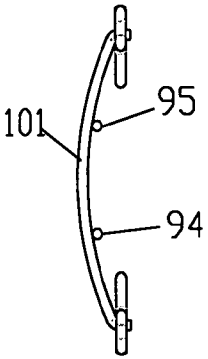
FIG. 8 is a right side view of the guard of FIG. 7.
Figure 7:
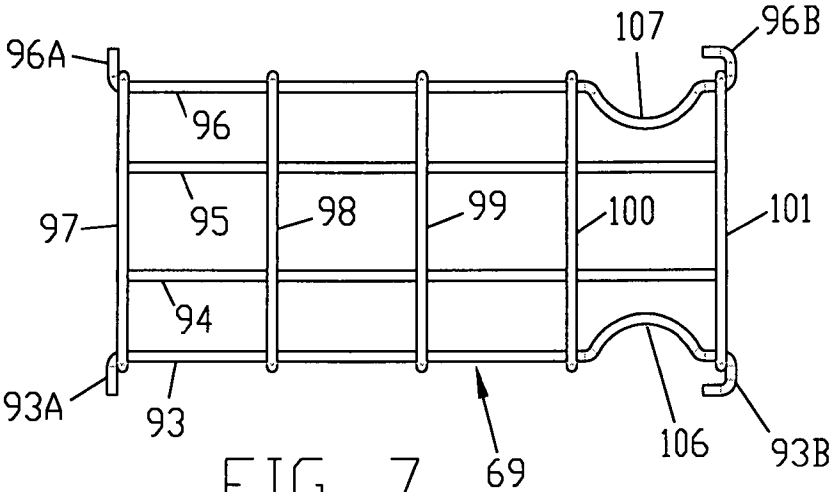
FIG. 7 is a bottom view of a protective guard for the fixture of FIG. 6.

Turning now to FIGS. 7 and 8, the protective grid 69 includes four longitudinally extending wires 93, 94, 95 and 96 which are welded or otherwise affixed to five transverse wires 97, 98, 99, 100 and 101 to form a rigid grid work or grid to prevent touching of the lamp housed within the reflector 80.

The ends of the outer longitudinal wires 93, 96 are extended slightly and bent outwardly respectively to form hinge pins 93A, 96A. The outwardly turned portions forming hinge pins 93A, 96A are received in the slots 31, 32 of the extruded housing 11; and they are sized so that they extend into the deeper recesses 34, 36 respectively. The hinge pins rest on the lower support shelves 39,40 of these slots, and are freely rotatable to act as hinges within the slots while supporting. The opposite ends of the outboard longitudinal wires 93, 96 form hooks as at 93B and 96B respectively. The hooks 93B and 96B are not fixed to the end cross wire 101. Rather, the hooks 93B, 96B may be squeezed inwardly toward one another slightly to remove the hooks from the slots 31, 32 so that the right end of the protective grid 69 (as seen in FIG. 7) may be rotated downwardly, away from the fixture, supported by the hinge formed by the turned portions 93A, 96A described above. To facilitate gripping and squeezing of the two hook portions 93B, 96B, the right side of the outboard longitudinal wires 93, 96 are curved to form finger receptacles such as those designated 106 and 107 respectively.

Having thus disclosed in detail two embodiments of the present invention, persons skilled in the art will be able to modify certain of the structure which has been disclosed and substitute equivalent elements for those described while continuing to practice the principle of the invention; and it is, therefore, intended that all such modifications and substitutions be covered as they are embraced within the spirit and scope of the appended claims.

I claim:

1. A lighting fixture adapted for mounting to a ceiling comprising:

an elongated housing comprising a wall of extruded metal, said wall defining a continuous, elongated opening extending between first and second opposing edges of said wall, said elongated opening facing downwardly when said fixture is mounted, said housing defining first and second open ends and first and second elongated opposing slots extending respectively along said first and second opposing edges of said housing;

first and second end plates attached to said first and second ends of said housing respectively;

a light source mounted within said housing for transmitting light through at least a portion of said elongated opening of said wall;

at least one panel received in said first and second opposing slots of said housing;

each of said first and second elongated slots of said housing including a lower, deeper recess and an upper, shallower recess, said deeper recesses of said first and second slots cooperating to define a mount for slidably receiving a lamp guard;

a lamp guard received in said first and second deeper recesses of said first and second elongated slots and located beneath said light source for transmitting light to an area below said fixture;

said lamp guard comprising a wire-grid mounted to said opposing slots of said wall beneath said light source;

said lamp guard further comprising first and second laterally extending pivot members received respectively in said first and second elongated slots of said wall beneath said light source, and first and second latch members adapted to be received respectively in said first and second slots of said wall and actuated by first and second portions of said gridwork for reducing the spacing between said latch members to permit said grid to rotate for access to said light source.

2. The apparatus of claim 1 wherein said wall further includes a mounting slot extending along an upper portion of the inner surface thereof, said mounting slot defining a downwardly facing central opening extending in the direction of elongation of said housing for slidably receiving and securing lighting components.

3. The apparatus of claim 2 wherein said housing has an exterior surface and includes a plurality of fins extending in the direction of elongation of said housing and extending upwardly of the outer surface of said housing to assist in dissipating heat within said housing.

4. The apparatus of claim 1 wherein said light source is a flourescent lamp, said apparatus further including a ballast for said electric lamp mounted within said housing; and an opaque cover plate received in said first and second opposing slots of said housing beneath said ballast.

5. The fixture of claim 1 characterized in that the vertical height of said wall extrusion in a position of intended use is less than the horizontal width thereof.

* * * * *